US008402890B2

(12) United States Patent
Faber

(10) Patent No.: US 8,402,890 B2
(45) Date of Patent: Mar. 26, 2013

(54) SELF-INKING HAND STAMP

(75) Inventor: Ernst Faber, Wels (AT)

(73) Assignee: Colop Stempelerzeugung Skopek Gesellschaft m.b.H. & Co. KG, Wels (AT)

( * ) Notice: Subject to any disclaimer, the term of this patent is extended or adjusted under 35 U.S.C. 154(b) by 354 days.

(21) Appl. No.: 12/798,621

(22) Filed: Apr. 8, 2010

(65) Prior Publication Data

US 2010/0263560 A1 Oct. 21, 2010

(30) Foreign Application Priority Data

Apr. 17, 2009 (AT) ..... A 596/2009

(51) Int. Cl.
*B41K 1/42* (2006.01)

(52) U.S. Cl. ..... 101/334; 101/104

(58) Field of Classification Search ..... 101/103, 101/104, 333, 334, 405
See application file for complete search history.

(56) References Cited

U.S. PATENT DOCUMENTS

| | | | | |
|---|---|---|---|---|
| 232,349 | A * | 9/1880 | Hill | 101/334 |
| 454,499 | A | 6/1891 | Ryer | |
| 1,834,629 | A | 12/1931 | McArdle | |
| 2,252,649 | A * | 8/1941 | Smallman | 101/333 |
| 5,850,787 | A | 12/1998 | Pichler | |
| 7,464,643 | B2 | 12/2008 | Pointl | |
| D618,274 | S * | 6/2010 | Faber | D18/15 |
| 7,761,959 | B2 * | 7/2010 | Shih | 16/436 |
| 2008/0000369 | A1 | 1/2008 | Ameshofer | |

FOREIGN PATENT DOCUMENTS

| | | |
|---|---|---|
| AT | 380 836 | 7/1986 |
| AT | 001 185 | 12/1996 |
| AT | 001 659 | 9/1997 |
| AT | 501 318 | 8/2006 |
| DE | 2 006 182 | 8/1971 |
| DE | 295 21 420 | 3/1997 |
| GB | 1 323 049 | 7/1973 |
| GB | 2 309 420 | 7/1997 |
| WO | WO 2005/037565 | 4/2005 |

OTHER PUBLICATIONS

Austrian Office Action dated Feb. 17, 2010 with an English translation of the relevant parts.

* cited by examiner

*Primary Examiner* — Judy Nguyen
*Assistant Examiner* — Leo T Hinze
(74) *Attorney, Agent, or Firm* — Collard & Roe, P.C.

(57) ABSTRACT

A self-inking hand stamp comprising a frame made of metal and having two side walls which are interconnected by an upper cover wall, and further comprising an actuating bow made of metal which, when used, is downwardly movable relative to the frame against a spring force. The actuating bow has two legs which are displaceable along the side walls of the frame; said legs are coupled to a type unit that is displaceable and turnable within the frame; resting projections are provided in the upper region of the frame for an insertable ink pad holder, said resting projections protruding inwards from the inner side of the side walls of the frame; the resting projections are provided on carrying members provided on the outer sides of the side walls and extend through openings in the side walls.

10 Claims, 8 Drawing Sheets

SELF-INKING HAND STAMP

CROSS REFERENCE TO RELATED APPLICATIONS

Applicant claims priority under 35 U.S.C. §119 of Austrian Application No. A 596/2009 filed Apr. 17, 2009.

FIELD OF THE INVENTION

The invention relates to a self-inking hand stamp comprising a frame made of metal and having two side walls which are interconnected by an upper cover wall, and further comprising an actuating bow made of metal which, when used, is downwardly movable relative to the frame against a spring force, the actuating bow having two legs which are displaceable along the side walls of the frame, said legs being coupled with a type unit that is displaceable and turnable within the frame, resting projections being provided in the upper region of the frame for an insertable ink pad holder, said resting projections protruding inwards from the inner side of the side walls of the frame.

BACKGROUND OF THE INVENTION

Such so-called (full) metal self-inking hand stamps have been known for a long time, cf. U.S. Pat. No. 454,499 A, and have been appreciated for their robustness and long useful life. The frame, also called stamp housing, usually consists of a steel sheet part which, after having been cut out or punched out, is bent accordingly, cf. e.g. also AT 1 185 U1, FIG. 5. When actuating the hand stamp, i.e. when making a stamp imprint, the actuating bow is moved downwards along the frame that has been put onto a substrate, wherein the legs of the actuating bow, which is U-shaped in elevation, are displaced along the outer sides of the side walls of the frame. A tube attached on top of the cover plate of the frame allows for guiding and position-safeguarding, which tube is telescopically insertable into a corresponding tube or the like receiving means in a handle on the actuating bow, the tube usually containing a helical compression spring, cf. e.g., also AT 380 836 B or AT 1 659 U1. An additional guiding of the legs of the actuating bow on the side walls of the frame is obtained in that the bow legs are coupled with a turning axle or with axle stubs of the type unit, e.g. a simple stamp plate or a unit with belt types, the ends of this axle or of these axle stubs being guided in a slot guide in the side walls of the frame. However, neither this axle guide nor the telescopic tube are intended as the guide proper for the actuating bow on the frame, much rather these components a priori have other functions and, therefore, malfunctions to the point of canting or self-locking of the actuating bow on the housing of the hand stamp may very well occur.

For this reason, hood-shaped guiding parts of plastics material put on the frame have already been suggested in the past, cf. the afore-mentioned AT 1 185 U1 or also AT 1 659 U1, so as to guide the actuating bow on the metal frame by said hood-shaped guiding part. In this hood-shaped guiding part, also an insertion compartment for an ink pad holder has been provided above the metal frame. Therefore, the upper cover wall of the frame had to be provided with an appropriately large opening for the passage of the stamp types so that the latter ones can get into contact with the ink pad located thereabove when they are in their upper inking position.

These hood-shaped guiding parts cause, however, substantial expenditures when producing and assembling the hand stamp. This is the more so for a steel/plastics composite design of frame and actuating bow, such as proposed in AT 501 318 B1, or also in DE 295 21 420 U1, e.g., where metal parts are received in fitting plastics parts. Moreover, the large opening in the cover wall of the frame negatively affects the strength and stability of the latter.

In the initially mentioned U.S. Pat. No. 454,499 A, a possibility for an insertion guide of an ink pad holder directly in the metal frame has already been shown, wherein resting projections are provided in that either lugs are punched out of the side wall of the frame and bent inwards, or in that angle brackets are riveted to the side walls of the frame, on the inner side thereof. Such inwardly riveted angle brackets may, however, cause restrictions in terms of dimensioning and movability of the type unit during turning and downward and upward movements thereof, apart from the fact that the attachment of angle brackets in the inner space of the stamp frame is comparatively cumbersome. If the resting projections are formed by legs which have been punched out and bent, an exact production will be necessary since otherwise the ink pad holder will either knock against the bent lugs and thereby obviate its proper insertion in the frame, or the fit for the ink pad holder in the upper region of the frame will only be a loose one so that the ink pad holder may unintentionally fall out of the hand stamp. Therefore, time and again, in practice, with the bent-out lugs, comparatively complicated readjustments are necessary.

SUMMARY OF THE INVENTION

It is now an object of the invention to provide a self-inking hand stamp of the type as mentioned above which allows for a simple, yet reliable attachment of an ink pad holder in the upper region of the metal frame of the hand stamp, wherein, moreover, the expenditures for the production and mounting shall be kept low.

At the self-inking hand stamp of the initially defined kind, the resting projections are, according to the invention, provided on carrying members which are applied to the outer sides of the frame side walls, wherein the resting projections extend through openings in the side walls.

At the present self-inking hand stamp, thus, the resting projections for the ink pad holder are provided on separate carrying members mounted externally on the frame, and the resting projections project from the carrying members and extend into the inner space of the frame through openings in the side walls. In this case, the openings in the side walls may, e.g., simultaneously be provided when cutting out the steel sheet blank for the frame, and the carrying members may be platelet-shaped and may be provided to closely lie at the outer sides of the side walls. In this case, the platelet-shaped carrying members may be provided in the region where the legs of the actuating bow abut on the side walls of the frame and, thus, can form a slide bearing or guide for the legs on the frame. If the carrying members are made of plastics material, such as POM, ABS or PE, e.g., a smooth-running guiding of the legs on the frame will be enabled, a contact of metal on metal being avoided. It is, however, also conceivable to fix separate carrying members, e.g. one respective carrying member, by means of a single resting projection, in corresponding openings on each one of the side walls of the frame by latching engagement therein. The exterior carrying members or holding members may then be provided at a distance from the legs of the actuating bow.

In any event, for mounting the carrying members, it is advantageous if they have latching projections by means of which they may be simply fixed in associated latching openings of the frame side walls by snapping engagement. For a good positioning and a high position stability it is, furthermore, suitable if the resting projections are provided above the latching projections. By the fact that in that case always two projections are provided one above the other, which projections extend through separate openings (or which project through a common, slot-shaped, elongate opening), rotation of the respective carrying member is effectively counteracted. In a simple embodiment, however, it is also conceivable that the latching projections themselves constitute the resting projections. In this case, the projections suitably have a non-round, e.g. a rectangular, cross-section so as to counteract a rotation in the latching opening.

As has already been mentioned before, the carrying member on its outer side can be additionally used as a bearing or guide for the respective bow leg; therefore, it is particularly suitable for guiding the bow legs on the frame if on the outer sides of the carrying members which face away from the resting projections, guiding webs are formed for the respective legs of the actuating bow. In that case, the carrying member additionally constitutes a guiding member for the respective bow leg.

For a particularly good positioning and fixation of the carrying and guiding members in their positions, respectively, it is, furthermore, advantageous if each carrying member has an upper, flange-like roof projection which abuts on an upper transition region joining the side wall to the upper cover wall of the frame.

In order to additionally support an ink pad holder in its inserted state and, optionally, slightly retain it in the inserted position by frictional (non-positive) engagement, it is also advantageous if on a broadside, the frame has a web or transverse wall joining the upper cover wall, and if a further resting projection for the ink pad holder in its inserted position is provided on the inner side of said web or transverse wall.

In this case, it is furthermore suitable if the further resting projection is formed by a lug that is cut out, or punched out, respectively, and bent out of the web. The lug forming the further resting projection on the transverse wall may in this case have an inclined position, i.e. may be obliquely upwardly directed from its starting point on the transverse wall so as to ensure a resilient abutment on the rim of the ink pad holder to the extent desired.

With a view to the desired fixing by latching engagement as well as, optionally, the advantageous sliding guiding of the bow legs it is, as has been mentioned, particularly advantageous if the carrying members are made of plastics, such as POM, ABS or PE, e.g. In this case, if necessary or desired, during insertion of an ink pad holder, the resting projections may be slightly downwardly deflected under elastic deformation to thereby allow for insertion of the ink pad holder without any problems as well as retention of the ink pad holder by elastic, frictional abutment on the latter.

BRIEF DESCRIPTION OF THE DRAWINGS

The invention will be explained hereinafter in more detail by way of preferred embodiments to which, however, it shall not be restricted, and with reference to the drawings. Therein.

DETAILED DESCRIPTION OF PREFERRED EMBODIMENTS

Figure 1:
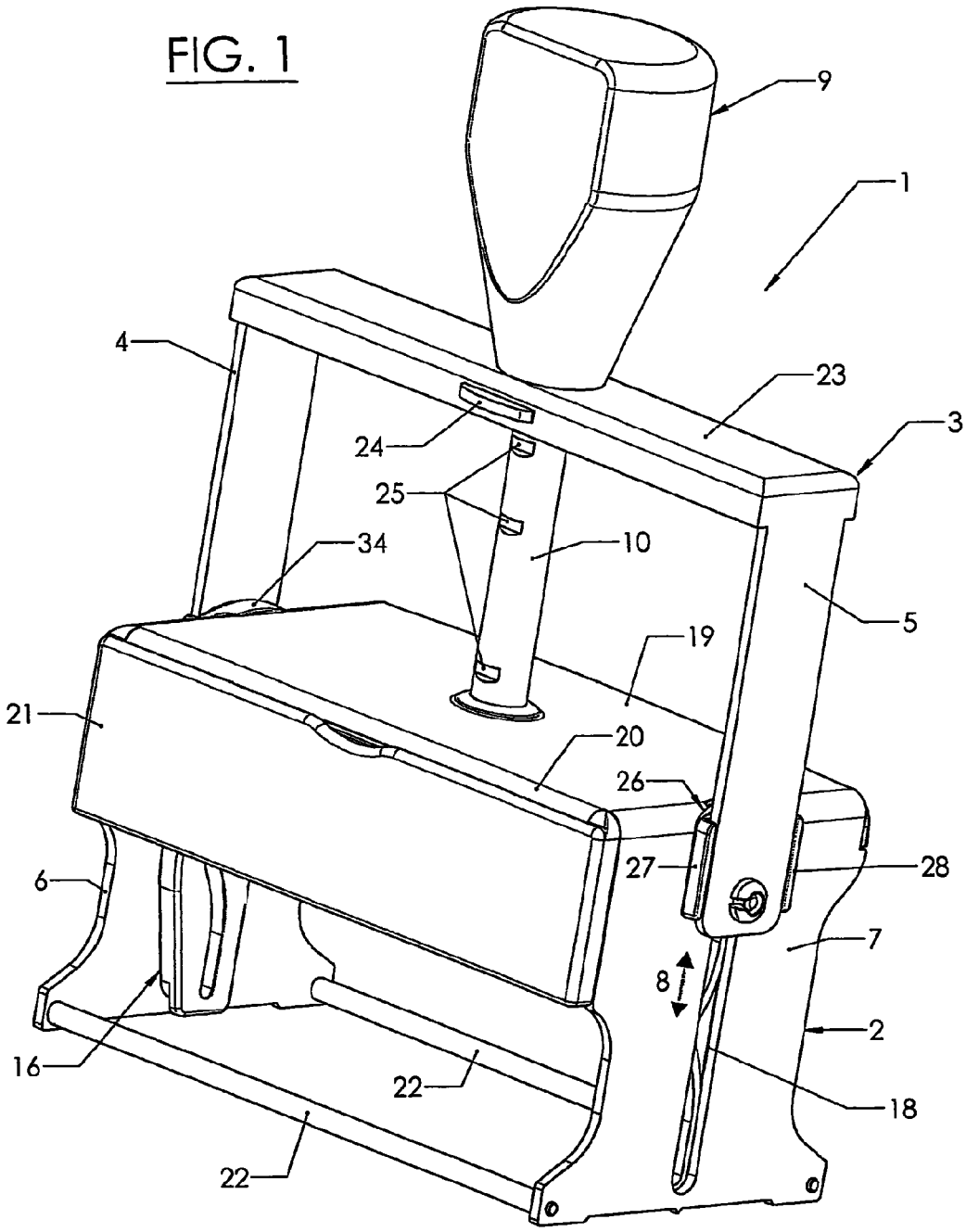
FIGS. 1 and 2 show a self-inking hand stamp according to the invention in axonometric views from the upper front side (FIG. 1), and from the lower front side (FIG. 2)
Figure 2:
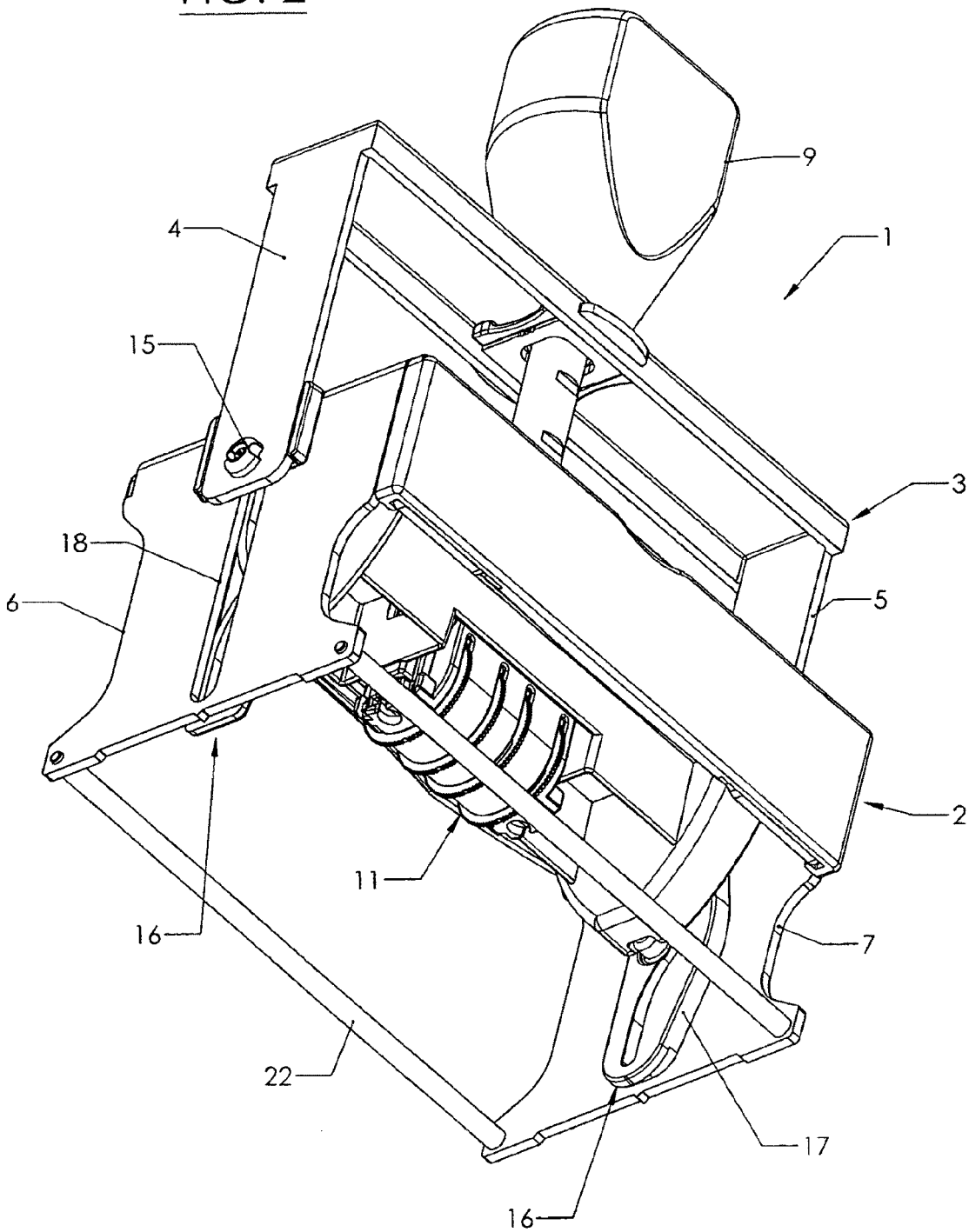

In FIGS. 1 to 6, a hand stamp 1 with a self-inking mechanism, called self-inking hand stamp 1 in short, is illustrated, which includes a frame or a housing 2 made of metal as well as an actuating bow 3 which is U-shaped in elevation, and is also made of metal. The actuating bow 3 has two legs 4, 5 which are guided on the outer sides of side walls 6, 7 of the metal frame 2 in the operating position so as to be vertically upwardly and downwardly movable, cf. also arrow 8 in FIG. 1. On the upper side of the actuating bow 3, a common handle 9 is attached which, on its inner side, is at least partially hollow so that, in a usual manner, a tube socket 10 can be accommodated in the interior of the handle 9, which tube socket is fixedly attached to the frame 2 on the upper side thereof and serves to receive a helical compression spring (not shown), as is known per se, which spring is supported on the upper side of the frame 2, on the one hand, and in the interior of the handle 9, on the other hand, so as to press the actuating bow 3 upwards according to the illustration of FIG. 1, into the illustrated rest (or non-use) position. The actuating bow 3 can be displaced downwards against this spring force, when making a stamp imprint on a substrate (paper etc.) by means of a type unit 11 mounted within the frame 2 (cf. e.g. FIG. 2 and 4, or 5, respectively). In doing so, during this downward movement of the actuating bow 3, the type unit 11 is downwardly displaced, and is additionally turned about its axle by 180°, as is known per se, so as to pivot the printing types—which in their upper rest position abut on an ink pad 12 of an ink pad holder 13 mounted in the upper region of the frame 2—by 180° and move them downwards so as to reach the imprinting position shown in FIG. 5. For this displacement movement, the legs 4, 5 of the actuating bow 3 are coupled to the ends of a turning axle 14 of the type unit 11 which is particularly visible in FIG. 5 (or to axle stubs laterally projecting from the type unit) via axle securing elements 15 known per se. Moreover, an also per se conventional, known turning mechanism 16 is provided for pivoting the type unit 11, e.g. by means of two control link elements 17 (cf. FIGS. 2 to 5) pivotably linked to the top of the inner sides of the side walls 6, 7 of the frame 2. For guiding the ends of the turning axle 14, vertical longitudinal slots 18 are provided in the frame side walls 6, 7.

Yet, the turning mechanism 16 may, of course, also be realized in another known form, such as shown in U.S. Pat. No. 454,499 A.

The metal frame 2 is formed of a punched or cut-out and appropriately bent steel sheet portion, the two side walls 6, 7 being integrally interconnected by an upper cover wall 19. On this cover wall 19, at the centre thereof, the tube socket 10 for the helical compression spring is fixedly attached in a manner known per se, e.g. by riveting. Furthermore, as can be seen from FIGS. 1 and 2, on the broad front side of the hand stamp 1, there is a strip or web-shaped transverse wall 20 extending downwards from the cover wall 19, cf. also the sectional illustration in the corner region in FIG. 6, this transverse wall 20 extending from one side wall 6 to the other side wall 7 and, in the exemplary embodiment illustrated, being provided with a transparent, slipped-on plastics pocket 21 as an inspection window for accommodating a stamp-print sample sheet. On their lower sides, in the corner regions, the frame side walls 6, 7 are interconnected and, thus, are stabilized in their positions in a per se conventional manner by rods 22.

Figure 3:
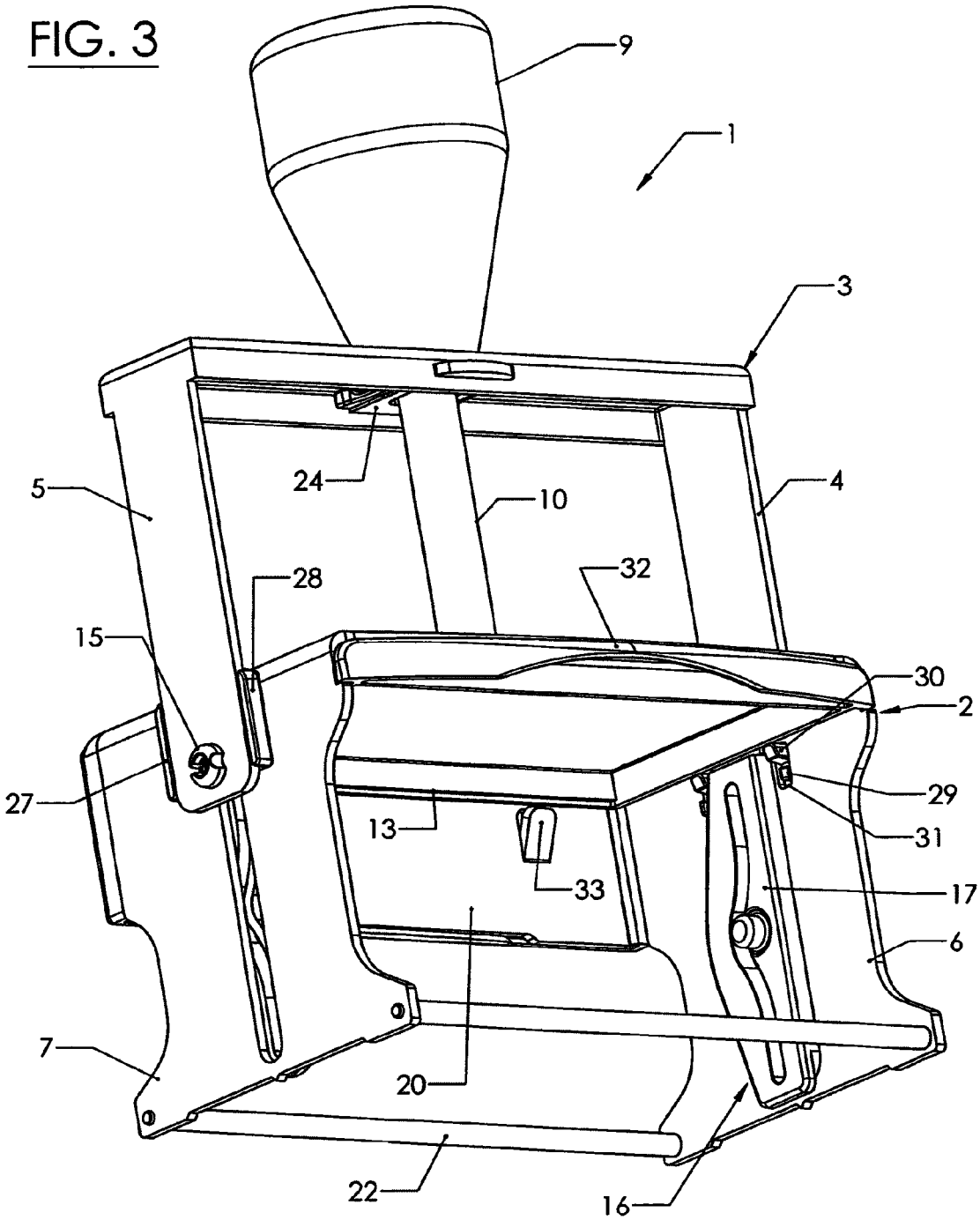
FIG. 3 shows an axonometric view of this hand stamp according to FIG. 1 from the rear side, with the type unit removed, so as to show the inner space of the frame of the hand stamp more clearly.

The two legs 4, 5 of the actuating bow 3 are also produced in one piece of steel sheet and interconnected by a web 23, which web moreover accommodates a slide 24 which can particularly be seen in FIGS. 1 and 3; by engagement of the latter in one of several depressions 25 on the tube socket 10, the actuating bow 3 can be fixed in a pre-determined position relative to the frame 2, e.g. so as to be able to readjust type belts in case of a type unit 11 comprising type belts indicating the date or the like, as shown, or, in particular, so as to be able to impregnate the ink pad 12 with ink.

As described so far, the present hand stamp 1 is of a per se known construction, and a more detailed description of the assembly and function of the hand stamp 1 is not required.

In the present hand stamp 1, on each frame side wall 6, 7, a one-piece plastics carrier or guiding member 26 is attached to the outer side of the respective side wall, and fixed thereto by latching engagement; each plastics carrier member 26 comprises guide webs 27, 28 for the respective leg 4 or 5, respectively, of the actuating bow 3. As can best be seen in FIGS. 7A, E and F, this carrier and guiding member 26 is generally platelet-shaped and, in particular, shaped or injection-moulded, respectively, of plastics, such as, e.g., POM, ABS or also PE. On the one side, i.e. the outer side, of this platelet-shaped carrier and guiding member 26, the above-mentioned guiding webs 27, 28 for the respective leg 4 or 5, respectively, of the actuating bow 3 are provided. On the other side, i.e. the inner side, latching projections 29 for fastening to the respective side wall 6 or 7, respectively, on the one hand, as well as resting projections 30 for the ink pad holder 13, on the other hand, are provided. As can particularly be seen in FIG. 7E, the latching projections 29 are hook-shaped, and with these hook-shaped latching projections 29, the carrier/guiding member 26 is fixed by latching engagement in corresponding (latching) openings 31 (cf. FIGS. 3 and 5) of the side walls 6, 7 of the frame 2. From FIG. 3, moreover, an empty ink pad holder 13 can be seen, which rests on the resting projections 30 of the respective combined carrier/guiding member 26 (cf. also FIG. 5) with its—in this operating position—lower rim of its two broadside walls, and, thus, can be pushed in or out similar to a drawer. For this purpose, it can be provided with a handle region 32 that can be seen in FIG. 3.

Figure 6:
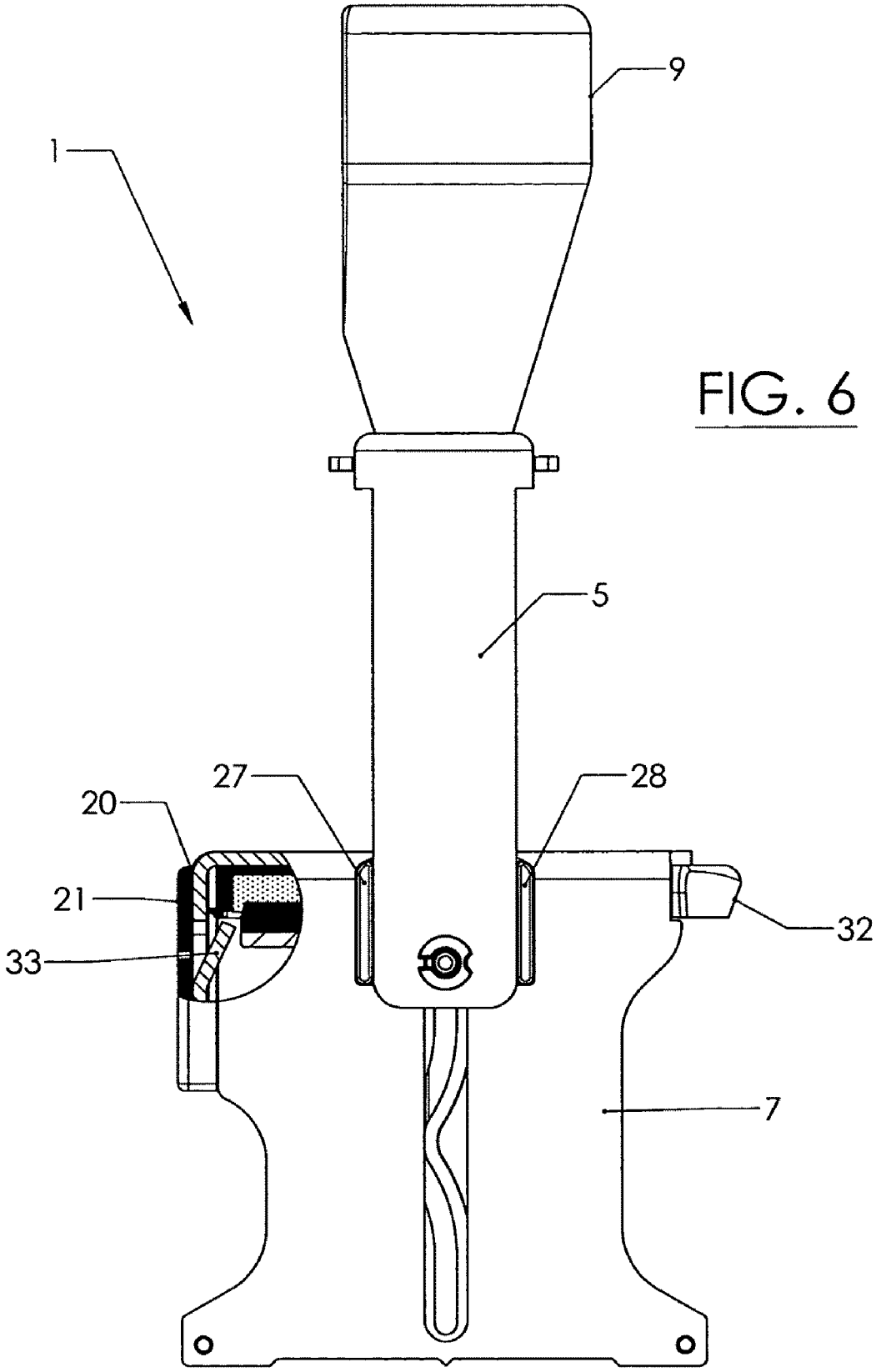
FIG. 6 shows a partially broken-away side view of the hand stamp according to FIGS. 1 to 5 for illustrating a resting projection in the region of the front side of the frame for supporting an ink pad holder.

From FIG. 3 and also from FIG. 6 it can, furthermore, be seen that the front-side transverse wall 20 which extends between the side walls 6, 7 of the frame 2 is cut out or punched out in certain areas thereof, so that bent-out lugs are formed as further resting projections 33 for the one longitudinal side of the ink pad holder 13. These lugs or projections 33, respectively, extend preferably, as can be seen in FIGS. 3 and 6, from the transverse wall 20 obliquely upwards, whereby the force with which the lugs 33 press against the ink pad holder 13 can be dimensioned in the suitable range in a simple manner.

Figure 4:
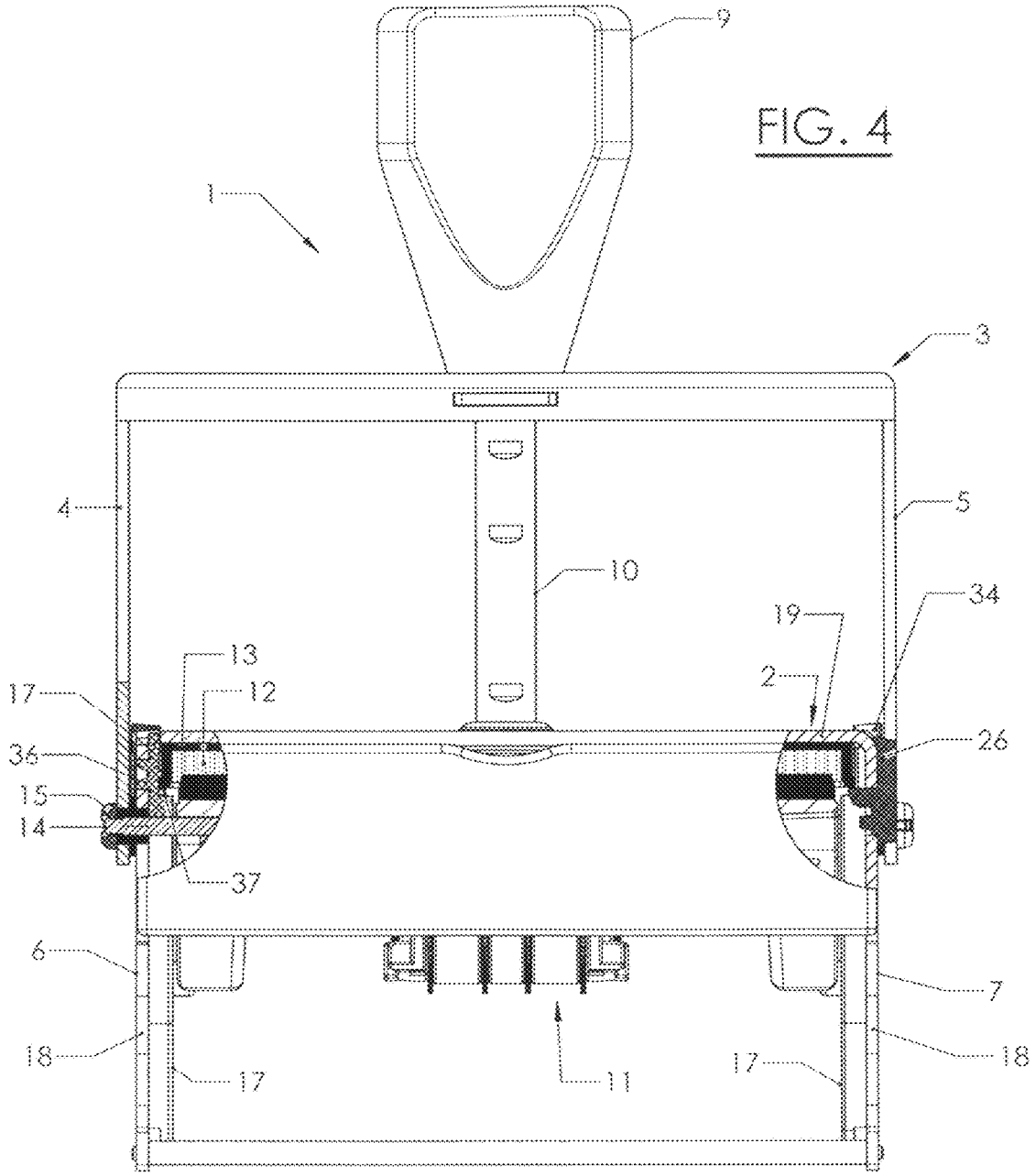
FIGS. 4 and 5 show front views of the hand stamp according to FIGS. 1 to 3 in the resting position (FIG. 4) and in the stamping or imprinting position (FIG. 5), wherein corner regions of the stamp frame have been broken away so as to illustrate details with regard to the coupling of a turning axle with the actuating bow, the hinging of a pivotable link which controls turning of the type unit of the hand stamp, as well as in particular the latching of a platelet-shaped guiding member.
Figure 7:
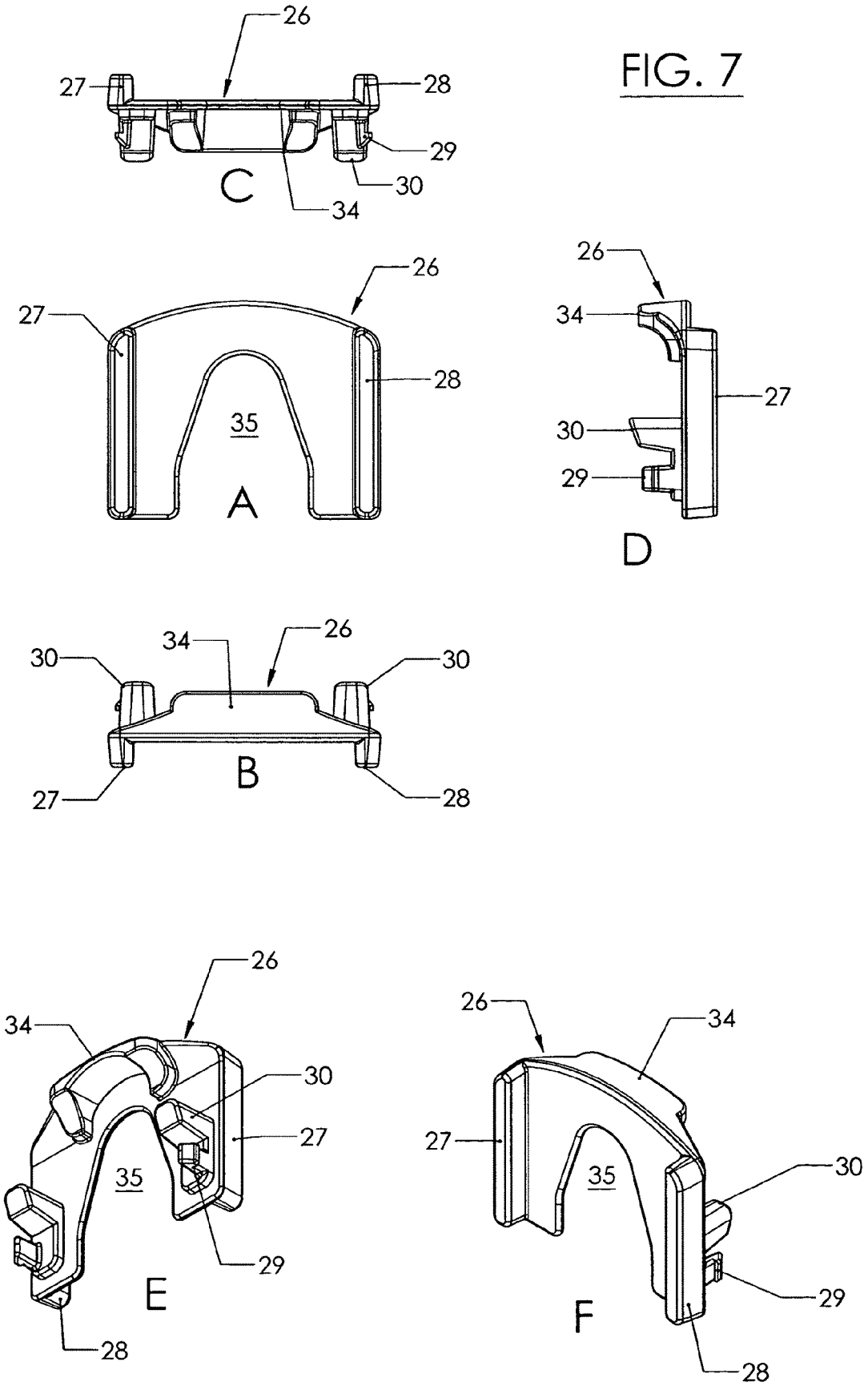
FIG. 7, in partial figures A to F, shows a platelet-shaped guiding member as provided in the present hand stamp for guiding a leg of the actuating bow on the stamp housing or frame, in a front view (A), a top view (B), a bottom view (C), a side view (D), an axonometric view of the inner side (E), and an axonometric view of the outer side (F)

From FIG. 7, in partial figures B and C to F, it can, furthermore, be seen that the platelet-shaped carrier/guiding member 26 on its upper side, on that side which faces away from the guiding webs 27, 28 for the bow legs 4, 5, has a roof projection 34 with which, when in its mounted position, this member 26 rests on the transition from the respective side wall, e.g. 7, to the upper cover wall 19, cf. e.g. also FIG. 4. By this roof projection 34, an additional positive stabilisation of the carrier/guiding member 26 in its position mounted on the frame 2 is achieved.

In a modification of the embodiment according to FIGS. 1 to 7, the latching projections 29 and the resting projections 30 can also be formed by one and the same projections 29-30, i.e. the resting projections 30 may, e.g., be provided on their outer side or lower side with corresponding hooks for latching engagement in a corresponding opening in the frame side wall 6 or 7, respectively. In this way, the production is facilitated insofar as in the respective side wall 6 or 7 only a total of two openings must be provided for two combined projections 29-30, instead of a total of four openings, for two latching projections 29 and two resting projections 30. On the other hand, however, the embodiment illustrated has the advantage that the position of the respective carrier/guiding member 26 is fixed in its position on the frame 2 in a particularly stable manner.

Finally, it can be seen from FIG. 7, from the partial figures A, E and F, that the platelet-shaped carrier/guiding member 26 is provided with a downwardly open recess 35. In this manner, space is provided for the ends of the turning axle 14 in the upper position of the type unit 11 when the carrier/guiding members 26 are mounted on the frame 2, cf. e.g., the illustration on the left-hand side in FIG. 4: Here, it can be seen that the control link element 17 in its upper region, where it it pivotably mounted with a bearing projection 36 in the respective side wall, e.g. 6, can be flattened or stepped on its inner side, as shown at 37, so as to better provide space for the ink pad holder 13.

Figure 5:
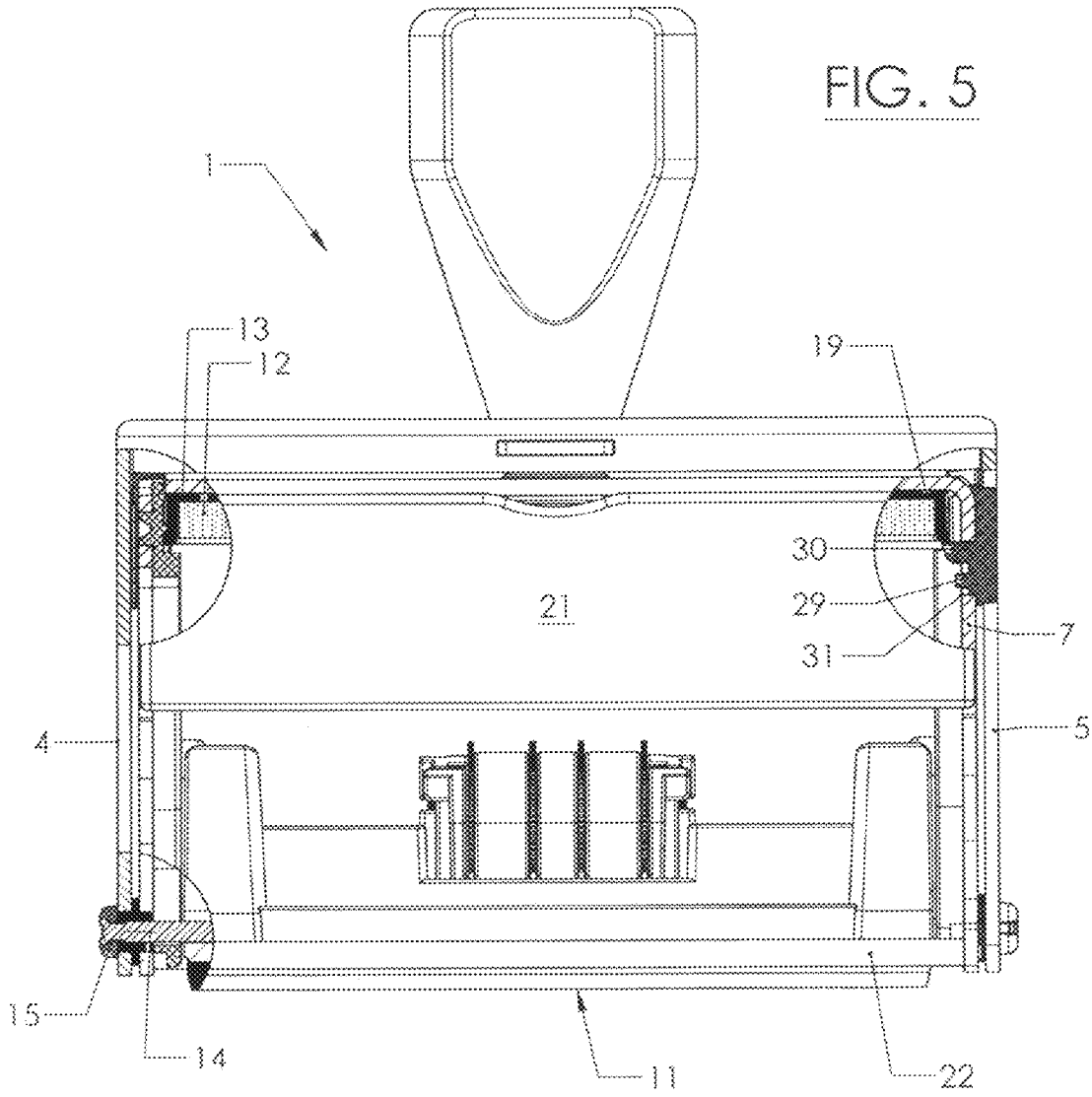

In the embodiment according to FIGS. 1 to 7, the respective actuating bow leg 4, or 5, respectively, slides on the platelet-shaped guiding member 26 with planar contact, cf. in particular the sectional representations in FIGS. 4 and 5, left side, wherein the platelet part proper of the carrier/guiding member 26 also acts as a spacer element between the respective side wall 6, or 7, respectively, and the associated leg 4, or 5, respectively. By this, sliding of metal on metal is avoided, and the guiding members 26 provide an advantageous, smooth-running sliding guide for the bow legs 4, 5.

Figure 8:
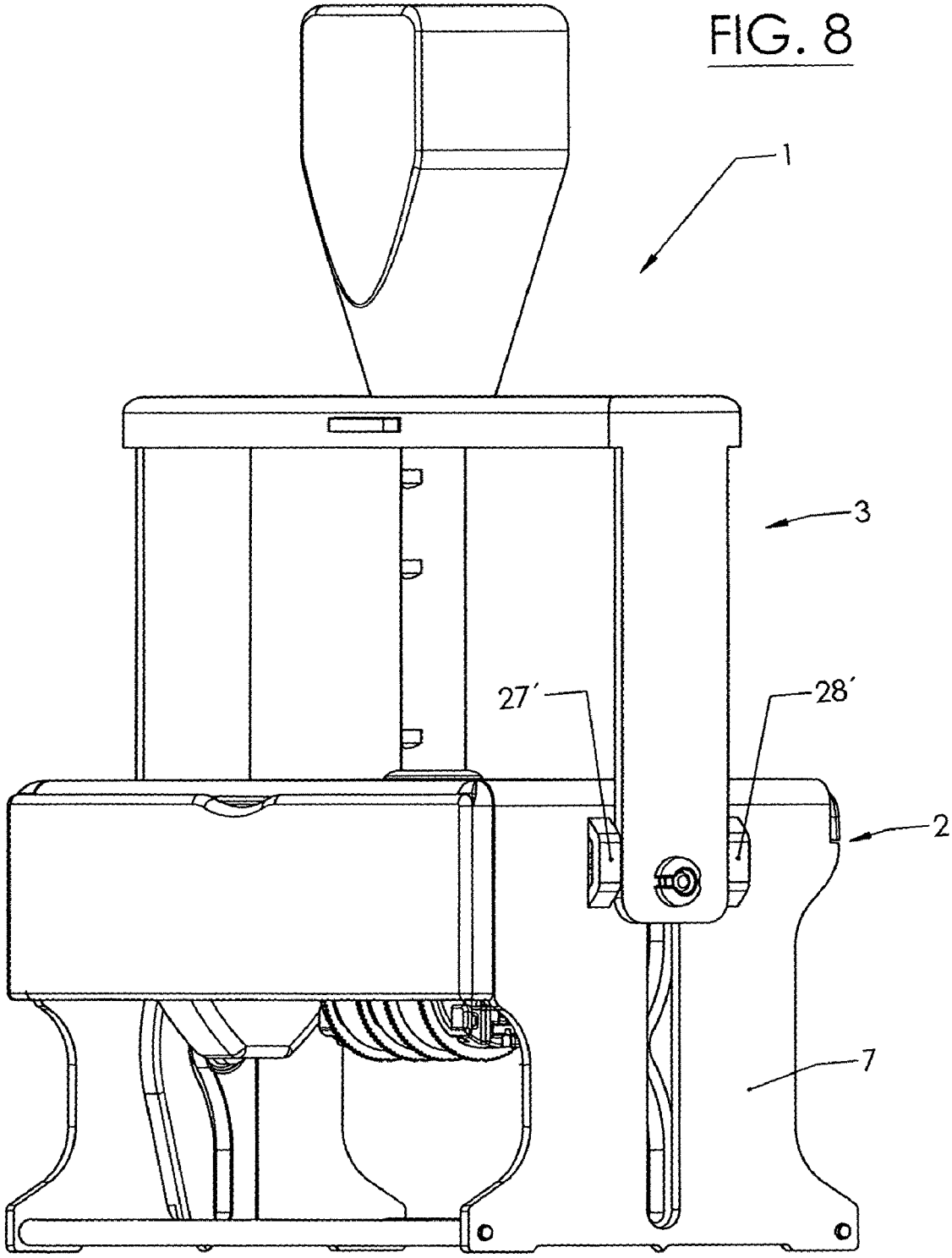
FIG. 8, in an axonometric view similar to FIG. 1, shows an alternative embodiment of a hand stamp having modified guiding webs for the legs of the actuating bow.

In FIG. 8, a guide for the bow legs 4, 5 which is simplified as compared to FIGS. 1 to 7 is provided in the form of a mere lateral guide by means of separate guiding webs 27', 28' which each are made of plastics (e.g. POM, ABS or PE), e.g., and are fixed by means of latching projections as described above (cf. the latching projections 29) on the associated side wall, e.g. 7, of the frame 2. Here, too, the separate guiding webs 27', 28' simultaneously are carrying members for inward resting projections corresponding to the resting projections 30 according to FIG. 7, to thereby provide for a retention of, and an insertion guide for, the ink pad holder 13 (not visible in FIG. 8, yet cf. FIG. 3).

With regard to the design of the frame 2 and of the bow 3, the hand stamp 1 according to FIG. 8 otherwise preferably corresponds to that according to FIGS. 1 to 7 so that a further description is not necessary.

Even though in the foregoing description the invention has been explained in more detail by way of preferred exemplary embodiments, changes and modifications are possible within the scope of the invention. Thus, e.g., also type units other than a type unit 11 as shown may be used, e.g. such one having a simple printing plate with a fixed text instead of a type unit having adjustable type belts, optionally in combination with an unchangeable text adjacent the adjustable types. The resting projection 33 bent outwards from the front-side transverse wall 20 may also be wider than that shown in FIG. 3, wherein, e.g., an extension over half of the length of the transverse wall 20 would very well be conceivable.

What is claimed is:

1. A self-inking hand stamp comprising a frame including two side walls with openings therein, and an upper cover wall, said upper cover wall interconnecting said two side walls, an actuating bow, said actuating bow being downwardly movable relative to said frame against a spring force, said actuating bow including two legs, said legs being displaceable along the side walls of said frame, a type unit displaceably and turnably arranged within said frame, said type unit being coupled to said legs of said actuating bow, and carrying members attached to the outer sides of said side walls of the frame in the upper region of said frame, said carrying members including resting projections which extend through said openings in said side walls of the frame and project inwards from the inner sides of the side walls, so as to accommodate and carry an insertable ink pad holder.

2. The hand stamp set forth in claim 1, further comprising latching projections provided on said carrying members, and associated latching openings provided in said frame side walls, said carrying members being fixed in said associated latching openings by snapping engagement of said latching projections in said latching openings.

3. The hand stamp set forth in claim 2, wherein said resting projections are provided above said latching projections.

4. The hand stamp set forth in claim 2, wherein said latching projections themselves constitute said resting projections.

5. The hand stamp set forth in claim 2, wherein said carrying members are made of plastics.

6. The hand stamp set forth in claim 5, wherein said plastics is selected from the group consisting of POM, ABS and PE.

7. The hand stamp set forth in claim 1, wherein said carrying members, on their outer sides, facing away from said resting projections, include molded guiding webs for the respective legs of said actuating bow.

8. The hand stamp set forth in claim 1, wherein each carrying member further comprises an upper flange-like roof projection, said roof projection abutting on an upper transition region extending from a respective side wall to said upper cover wall of said frame.

9. The hand stamp set forth in claim 1, wherein said frame has a broadside and includes a transverse wall arranged to join the upper cover wall on said broadside thereof, at least one further resting projection being provided on an inner side of said transverse wall so as to support an ink pad holder in an inserted position thereof.

10. The hand stamp set forth in claim 9, wherein said further resting projection is formed by a lug, said lug being cut out of said transverse wall and bent outwards.

* * * * *